United States Patent [19]

Queen

[11] 4,214,220

[45] Jul. 22, 1980

[54] WIDE RANGE MAGNETICALLY BIASED REED SWITCH

[75] Inventor: Daniel L. Queen, Chicago, Ill.

[73] Assignee: Chamberlain Manufacturing Corp., Elmhurst, Ill.

[21] Appl. No.: 939,486

[22] Filed: Sep. 5, 1978

[51] Int. Cl.[2] ..... H01H 51/27

[52] U.S. Cl. ..... 335/153; 335/179

[58] Field of Search ..... 335/153, 179

[56] References Cited

FOREIGN PATENT DOCUMENTS

| | | | |
|---|---|---|---|
| 1125076 | 3/1962 | Fed. Rep. of Germany | 335/153 |
| 1564164 | 1/1970 | Fed. Rep. of Germany | 335/153 |
| 1142055 | 2/1969 | United Kingdom | 335/153 |

*Primary Examiner*—Harold Broome

*Attorney, Agent, or Firm*—Hill, Van Santen, Steadman, Chiara & Simpson

[57] ABSTRACT

A normally closed reed relay switch is provided having an enhanced ratio of reclosure to open current. A permanent magnet is used to bias closed a normally open reed relay switch. An electrical coil is placed around one end of the reed relay switch so as to offset the flux distribution of the permanent magnet thereby allowing the switch to assume an open position. The position of the magnet and the coil with respect to the reed relay switch results in an enhanced ratio of reclosure to open current on the order of 10 to 1.

6 Claims, 3 Drawing Figures

WIDE RANGE MAGNETICALLY BIASED REED SWITCH

BACKGROUND OF THE INVENTION

1. Field of the Invention

The field of the invention is that of magnetic reed relay switches.

2. The Prior Art

The magnetic reed relay switch has become well known in the prior art. In its normal configuration the magnetic reed relay switch is a two terminal switch having a normally open configuration. The spring characteristics of the magnetic reed contacts which are usually housed in a non-magnetic closure, such as glass envelope, keep the contacts spread apart. A study state unidirectional magnetic field usually produced by a coil wound around the switch acts to create an attraction between the contacts of the switch. The attraction between the contacts of the switch causes them to close. Contact pressure is increased by the flux increase which is caused by the contacts closing hence, decreasing the reluctance of the circuit. In the normally open configuration, the spring forces of the contacts only need to be enough to overcome any residual magnetic forces due to the retentivity of the magnetic contacts and due to any micro-welding that might occur on contact closure.

To provide a normally closed operation, the switch must be provided in some fashion with another contact. The sensitivity of the switch for a given current handling capability is reduced, since the contact pressure must be obtained entirely from a high spring force which must be overcome by the magnetic field in order to open the contact.

In order to retain the advantage of the normally open configuration, the switch may be biased closed by means of a permanent magnet. An electromagnetic coil may then be used to overcome the permanent magnet bias thereby causing the switch to open. However, if the coil current is increased enough to totally cancel the permanent flux, then increase further, that relay will reclose. The ratio of reclosure to open current is on the order of 2 to 1 with the prior art switch arrangements.

SUMMARY OF THE INVENTION

The invention is a normally closed reed relay switch which combines the fields of electromagnet and a permanent magnet so as to achieve an enhanced ratio of reclosure to open coil current.

A normally open reed relay switch, without a control coil, has a permanent magnet positioned adjacent to one end thereof so as to cause the two contacts within the switch to close. The closure is achieved by a flux distribution from the permanent magnet which is substantially perpendicular to one of the magnetic reed contacts. An electrical coil is positioned over the other end of the reed relay. The coil is wound and a current is supplied through it so as to generate a magnetic field which is substantially parallel to the other contact of the reed relay, and having a polarity opposite to the polarity of the magnetic field induced in the first magnetic reed contact due to the permanent magnet.

By adjusting the value of the current supplied to the electrical coil, the magnetic field of a permanent magnet may be offset permitting the magnetic reed contacts to separate. The separation results in an open circuit between the terminals of the switch.

Because of the position of the permanent magnet and the electrical coil, while the current through the coil can offset the flux distribution due to the permanent magnet, only a proportioned large increase in the coil current, on the order of 10 to 1, will bring about reclosure of the reed relay contacts.

DETAILED DESCRIPTION OF THE PREFERRED EMBODIMENT

Figure 1:
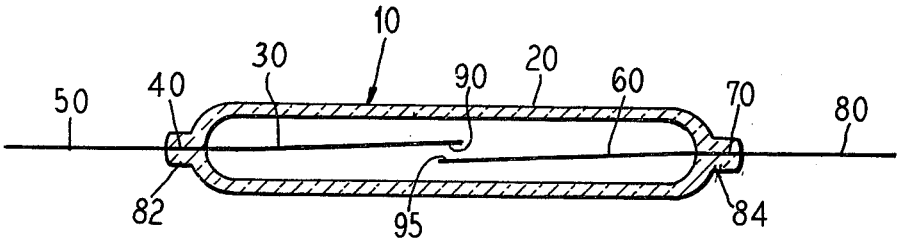
FIG. 1 is a section of a reed relay exclusive of control coil.

While the principles of the present invention find a particular utility in a normally closed reed switch, it will be understood that the reed switch arrangement of the present invention may be utilized in other combinations. By way of exemplary disclosure of the best mode of practicing the invention there is shown generally in FIG. 1 a reed switch 10 having none of the necessry control coils. The reed switch 10 has a non-magnetic envelope or body member 20, often made of glass, which encapsulates a first magnetic reed contact 30 which passes through the housing 20 at a port 40 and has an exteral contact 50 for making electrical connections to the switch 10. A second magnetic reed contact 60 is also positioned within the housing 20 and passes through the housing 20 at a point 70 and has an external contact 80 also used for making electrical contact to the switch 10. The housing 20 supports the magnetic reed contacts 30 and 60 physically in a sealed and protected environment by a pair of flanges 82, 84. A contacting surface 90 of the reed contact 30 is positioned adjacent to a contacting surface 95 of the reed contact 60. The switch 10 is a normally opened switch with the surfaces 90 and 95 not being in contact with one another. When the surfaces 90 and 95 are in contact with one another, a close circuit is formed between the terminal 50 and the terminal 80 of the switch 10. The magnetic reed contacts 30 and 60 are of a known and well understood type and the surfaces 90 and 95 are separated from one another in the normally open condition due to the spring-like characteristics of the reed contacts 30 and 60. The spring-like characteristics exert adequate spring force to overcome any residual magnetic forces due to the magnetic material which composes the reed contacts 30 and 60 and due to any micro-welding that may occur upon contact closure.

Figure 2:
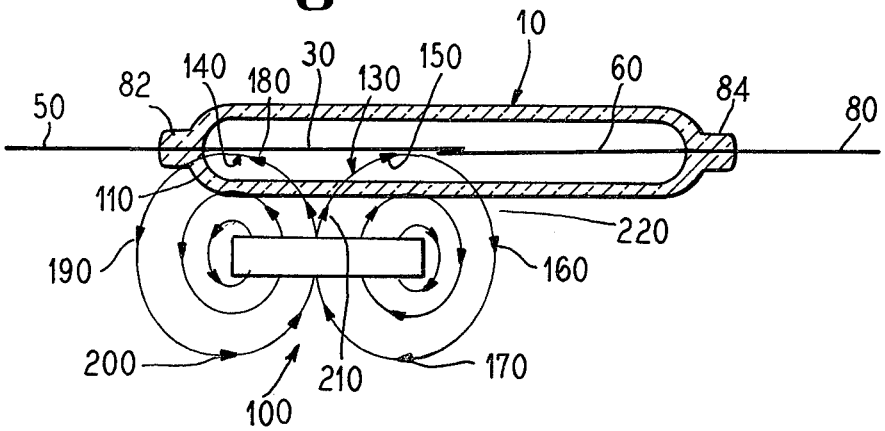
FIG. 2 is a section of a reed relay biased closed by a permanent magnet.

In order to retain the advantages of a normally open reed switch, the switch 10 of FIG. 1 is biased closed in FIG. 2 by a magnet 100. The magnet 100 is located near an end 110 of the reed switch 10. The magnet 100 has a flux distribution indicated by the flux lines 130 and 140. The flux line 130 has a polarity indicated by a set of arrows 150, 160 and 170. The flux line 140 has a polarity indicated by a set of arrows 180, 190, and 200. It will be understood, of course, as is well recognized in the art, that the magnet 100 generates a much more complex flux distribution of which the flux lines 130 and 140 are typical examples.

The flux line 130 has a pair of components 210, and 220 which are substantially perpendicular to the magnetic reed contact 30. The perpendicular components 210 and 220 of the flux line 130 along with other perpendicular components of similar flux lines cause the magnetic reed contact 30 to move against the magnetic reed contact 60 thereby closing the circuit between the terminals 50 and 80 of the switch 10. Because the magnet 100 is a permanent magnet, so long as it is spatially positioned as indicated in FIG. 2, it will pull the contacts 30 and 60 closed producing a normally closed circuit between the points 50 and 80.

Figure 3:
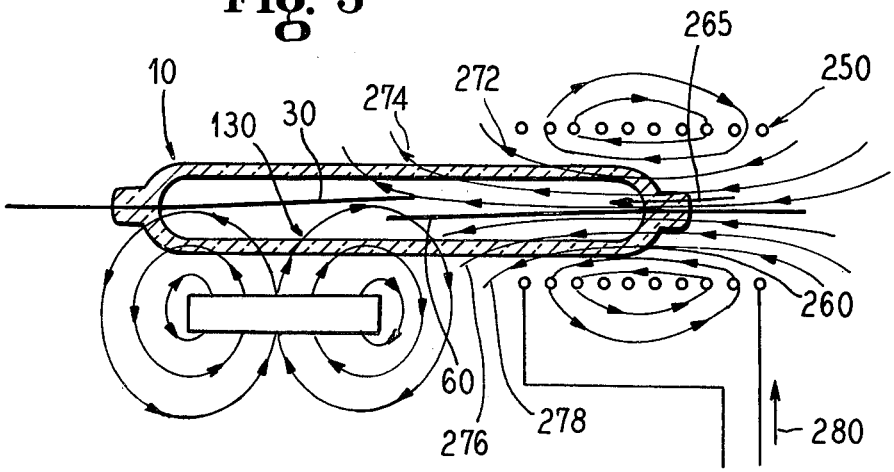
FIG. 3 is a schematic of a reed relay biased closed by a permanent magnet whose effects may be overcome by an electrical coil located at one end of the reed relay.

FIG. 3 discloses the magnetically biased reed switch 10 of FIG. 2 having a control coil 250 positioned near an end 260 of the envelope 10 surrounding the contacts 30 and 60. The coil 250 is designed to generate a magnetic flux 265 generally parallel to the contact 60, with the indicated polarity primarily near the end 260 of the reed switch 10. The flux 265 within the coil 250 includes a set of flux lines such as the typical flux lines 272, 274, 276 and 278. The polarity of the magnetic field 265 within the coil 250 and the flux lines 270, 272, 274, 276 is substantially parallel to the magnetic reed contact 60. Further, the magnetic field 265 of the coil 250 has a polarity opposite the polarity of the magnetic field which is induced in the reed contact 30 by the permanent magnet 100 as indicated by the flux line 130 with the indicated direction 160.

By making the field 265 strong enough, the magnetic flux lines such as the line 130 generated by the magnet 100 having the component 220 in the direction 160 may be cancelled. In this condition, the magnetic reed contacts 30 and 60 are subjected to no net-magnetic field and assume their normally open positon as was indicated in FIG. 1. When this occurs an open circuit appears between the terminal points 50 and 80.

When the current 280 is relatively small the flux 265 produced by the coil 250 will be inadequate to overcome the flux represented by the flux line 130 due to the permanent magnet 100. Hence, a small current 280 will not be able to open the switch 10. For proportionately large currents 280, the flux 265 in the interior 255 of the coil 250 will be effective to overcome the flux such as the flux line 130 generated by the permanent magnet 100 thus allowing the magnetic reed contacts 30 and 60 to open.

Because of the characteristics of the reed relay 10, if the current 280 is increased substantially large enough, the contacts 30 and 60 will reclose again. By locating the coil 250 as indicated in FIG. 3 near the end 260 of the housing 20, the ratio of reclosure to open current 280 is increased from a ratio of 2 without the invention to approximately 10 with the invention.

For exemplary purposes, an operable model embodying the present invention has the following characteristics:

(1) Length of reed relay envelope: 49 mm (2) Location of contact surfaces (such as 90, 95 of FIG. 1, with respect to reed relay envelope): centered in envelope (3) Location of the permanent magnet (corresponding to the magnet 100), with respect to the contact surfaces (such as 90, 95): 18 mm $\times$18 mm ceramic magnet, centered under spring 30.

(4) Location of the coil with respect to the contact surfaces (such as 90, 95): centered over junction 84 of glass and spring.

(5) Size of wire, number of turns and length of the coil: 4328 turns of AWG #39 copper wire with 22 mm winding length (6) Current values:

(*a*) To produce initial opening of the contact surfaces (such as 90, 95): 10 mA (*b*) To produce reclosure of the contact surfaces (such as 90, 95): $>$160 mA (heating prevents exact measurement)

Although various modifications might be suggested by those skilled in the art, it should be understood that I wish to embody within the scope of the patent warranted hereon all such modifications as reasonably and properly come within the scope of my contribution to the art.

I claim as my invention:

1. An improved, normally closed, reed relay having a hollow non-magnetic housing with a first and a second closed end;

a first and a second magnetic reed contact supported by the housing, with the first contact having a section extending through the first closed end and into the housing and the second contact having a section extending through the second closed end and into the housing and with an end portion of each of the sections positioned adjacent to one another within the housing to form an open circuit between the contacts;

the improvement comprising:

a permanent magnet, adjacent the outside surface of the housing, centered with respect to the section of the first contact within the housing, and having a flux distribution oriented substantially perpendicular to the first and second contacts such that the first and said second magnetic reed contacts form a closed circuit due to the effects of at least a portion of said flux distribution of said permanent magnet; and, an electrical coil adapted to receive the second end of the housing and substantially centered axially with respect to the second closed end of the housing where the section of the second contact enters the housing; said coil being operative to produce, in response to a first electrical current, a magnetic flux primarily near the second end of the housing, parallel to the second contact, of a selected magnitude, operative to offset at least a portion of said flux distribution of said permanent magnet resulting in said first and said second magnetic reed contacts forming an open circuit for the duration of said first electrical current in said electrical coil the location of said permanent magnet and of said coil with respect to the second end and the magnetic flux distribution associated with said coil requiring a second current, at least ten times greater than said first current, to reclose the contacts.

2. The improved reed switch according to claim 1 wherein:

said permanent magnet has a first planar surface oriented substantially parallel to an adjacent external surface of the housing and with a second planar surface spaced apart from said first surface.

3. The improved reed switch according to claim 1 wherein:

said coil has a substantially cylindrical shape with a through bore adapted to receive the second end of the housing.

4. The improved reed switch according to claim 2 having only a non-magnetic path for said portion of said flux distribution of said magnet forming said normally closed circuit between said second contact and said second surface of said magnet.

5. The improved reed switch according to claim 3 having only a non-magnetic path for said magnetic flux produced by said coil between a first end of said coil and an adjacent region of said second contact exterior to the housing and between a second end of said coil, and a selected section of the second contact within the housing.

6. An improved normally closed magnetic reed switch having a non-magnetic, closed, hollow housing with a first and a second contact each having a first region located within the hollow housing and an exterior connection region which extends through a first and a second junction point with a first and a second respective end of the housing;

each first region of each of the contacts having an end portion substantially centered axially within the hollow housing and adjacent the corresponding end region of the other of the contacts, the improvement comprising:

a single permanent magnet with a selected flux distribution, substantially centered with respect to the first internal region of the first contact, at least a portion of said flux distribution being effective to cause the end regions of the respective contacts to move into physical contact thereby forming a closed electrical circuit between the exterior connection regions of the respective contacts;

an electrical coil having a substantially cylindrical shape with a through bore adapted to receive the second end of the housing and substantially centered axially with respect to the second junction, at the second end of the housing;

said coil generating, in response to a first electrical current, a flux distribution substantially parallel to the second contact and effective to oppose and cancel said portion of said flux distribution of said magnet thereby enabling the respective end regions of the first and second contacts to move apart resulting in an open circuit between the exterior connection regions of the respective contacts;

said magnetic flux distribution of said magnet interacting with said flux distribution of said coil so as to inhibit said magnetic flux distribution of said coil from reclosing the end regions of the first and second contacts without a selected second current, having a magnitude at least ten times greater than said magnitude of said first current having been applied to said coil.

* * * * *